US005907257A

United States Patent [19]

Liu et al.

[11] Patent Number: 5,907,257

[45] Date of Patent: May 25, 1999

[54] GENERATION OF SIGNALS FROM OTHER SIGNALS THAT TAKE TIME TO DEVELOP ON POWER-UP

[75] Inventors: Lawrence Liu, Menlo Park, Calif.; Michael A. Murray, Bellevue, Wash.; Li-Chun Li, Los Gatos, Calif.

[73] Assignee: Mosel Vitelic Corporation, San Jose, Calif.

[21] Appl. No.: 08/853,291

[22] Filed: May 9, 1997

[51] Int. Cl.[6] ..... G05F 1/10

[52] U.S. Cl. ..... 327/535; 327/534; 327/143; 327/543; 327/546

[58] Field of Search ..... 327/536, 143, 327/142, 198, 535, 537, 538, 543, 545, 546, 534

[56] References Cited

U.S. PATENT DOCUMENTS

| | | | |
|---|---|---|---|
| 4,401,897 | 8/1983 | Martino, Jr. et al. | 307/297 |
| 4,795,918 | 1/1989 | Menon et al. | 307/297 |
| 4,902,910 | 2/1990 | Hsieh | 327/143 |
| 5,144,159 | 9/1992 | Frisch et al. | 307/272.3 |
| 5,214,316 | 5/1993 | Nagai | 327/143 |
| 5,278,798 | 1/1994 | Miyawaki | 365/229 |
| 5,313,112 | 5/1994 | Macks | 307/296.3 |
| 5,378,936 | 1/1995 | Kokubo et al. | 327/143 |
| 5,483,486 | 1/1996 | Javanifard et al. | 365/185.17 |
| 5,519,347 | 5/1996 | Kim | 327/143 |
| 5,592,121 | 1/1997 | Jung et al. | 327/541 |
| 5,712,584 | 1/1998 | McClure | 327/198 |

*Primary Examiner*—Timothy P. Callahan
*Assistant Examiner*—Jung Ho Kim
*Attorney, Agent, or Firm*—Skjerven, Morrill, MacPherson, Franklin & Friel LLP; Michael Shenker

[57] ABSTRACT

A bias voltage generator generates the same bias voltage VBB for different external power supply voltages EVCC (for example, for EVCC=3.3V or 5.0V). During power-up, the charge pump that generates VBB is controlled by an enable signal ExtEn referenced to EVCC. Later an internal supply voltage IVCC becomes fully developed to a value independent from EVCC (for example, IVCC=3.0V), and the charge pump becomes controlled by an enable signal IntEn referenced to IVCC. This enable signal IntEn will cause VBB to reach its target value, for example, −1.5V. This target value is independent of EVCC. During power-up, when the charge pump is controlled by ExtEn, the bias voltage VBB is driven to an intermediate value (for example, −0.5V or −1V). This intermediate value depends on EVCC, but is below the target value in magnitude. The intermediate value reduces the likelihood of latch-up during power-up, but the intermediate value does not go beyond the target value thus does not create a significant pn-junction current leakage in semiconductor regions to which the bias voltage is applied.

14 Claims, 6 Drawing Sheets

GENERATION OF SIGNALS FROM OTHER SIGNALS THAT TAKE TIME TO DEVELOP ON POWER-UP

BACKGROUND OF THE INVENTION

The present invention relates to generation of signals, and more particularly to generation of signals from other signals that take time to develop on power-up.

Some circuits develop signals not from signals immediately available on power-up, e.g. from an external power supply voltage, but from other signals that take time to develop during power-up, e.g. from an internal power supply voltage. One reason for using an internal power supply may be a desire to be able to use the same circuit with different external power supply voltages. Consider, for example, a semiconductor memory in which a substrate or a well is biased by a bias voltage selected to reduce transistor leakage current or to adjust transistor threshold voltages or junction capacitances. The bias voltage generator has to generate the correct bias voltages for different external power supply voltages. Bias voltage generation could be simplified if the bias voltage could be generated from an internal power supply voltage independent of the external power supply voltage level. However, the internal power supply voltage takes time to develop on power-up, which causes problems described below in connection with FIG. 2.

FIG. 1 illustrates a bias voltage generator 110 generating a bias voltage VBB from an external power supply voltage EVCC in a dynamic random access memory (DRAM). VBB is a negative voltage which biases the P substrate or P wells in which the NMOS transistors of DRAM cells are fabricated. The possible nominal EVCC values are 3.3V and 5.0V. However, the 5.0V EVCC could subject the transistors to high stresses. To avoid these stresses, the circuitry that drives the transistors uses an internally generated power supply voltage IVCC. IVCC is generated from EVCC so that IVCC is about 3.0V for either 3.3V or 5.0V EVCC values. Since IVCC is the same for different EVCC values, and since the DRAM cell transistors are driven by IVCC, VBB can be the same for different EVCC values. (In FIG. 1, VBB is about −1.5V.)

To generate the same VBB from different EVCC voltages, VBB generator 110 uses a fuse F1. When fuse F1 is intact, fuse F1 shunts the resistor R3 connected in parallel with the fuse. The resistor R3 is connected in series with resistors R2 and R1 between VBB and EVCC. If the memory is to operate at EVCC=3.3V, the fuse is blown. If the memory is to operate at EVCC=5.0V, the fuse is left intact. The resistors R1, R2, R3 are selected so that when VBB is at the desired value of −1.5V, the node 120 between the resistors R1 and R2 is at half EVCC (that is, 1.65V when EVCC=3.3V and the fuse is blown; 2.5V when EVCC=5.0V and the fuse is intact). Half EVCC is the trip voltage of CMOS inverter 124 whose input is connected to node 120. (The letter E inside the inverter symbol means that the inverter is powered by EVCC. The reference voltage is assumed ground unless mentioned otherwise.) Inverters 124, 130, 134, 138 are connected in series between node 120 and charge pump 140. These inverters are powered by EVCC. The output of inverter 138 provides the charge pump enable signal VBE. The charge pump is on when VBE is high. The charge pump is off when VBE is low. Thus, when VBB rises above −1.5V, the charge pump turns on. When VBB falls to −1.5V, the charge pump turns off.

Some embodiments use a mask option instead of fuse F1.

To eliminate the fuse or the mask option, some DRAMs generate the bias voltage VBB from IVCC because IVCC has the same value for different EVCC levels. See VBB generator 210 in FIG. 2. In VBB generator 210, resistors R4 and R5 are connected in series between IVCC and VBB. Node 120 between the resistors R4 and R5 is connected to the input of inverter 214 powered by IVCC. The output of inverter 214 is connected to the input on inverter 218 also powered by IVCC. The output signal IntEn of inverter 218 is provided to the charge pump (not shown) as the enable signal VBE. The resistors R4 and R5 are selected so that when VBB is at the desired value of −1.5V, node 120 is at the trip voltage of inverter 214. The trip voltage is one-half of IVCC, that is, 1.5V.

Bias voltage generator 210 has the following disadvantages associated with power-up. Since the internal voltage IVCC is used by many circuits in the memory, the IVCC terminal has a fairly large capacitance. Therefore, on power-up, a large amount of time elapses before IVCC develops. Another reason why IVCC is slow to develop is the use of low-power, slow circuitry for IVCC generation. The circuitry is made slow to reduce its DC power consumption. Because IVCC is slow to develop, IntEn does not enable the charge pump until long after the power has been turned on. During that period of time, the potential of the substrate or P wells biased by VBB could become positive, causing a latch-up.

One solution of this problem is to use the inverse of IntEn, i.e. the signal IntEn-, to control the charge pump. (IntEn- is generated from IntEn by inverter 230 powered by IVCC.) In such a circuit, the charge pump is turned on when IntEn- is low. The circuitry (not shown) detecting the level of IntEn-, and the charge pump, are driven by EVCC. Therefore, this circuitry and the charge pump become fully operational right away, before IVCC develops. When the power is first turned on, IntEn- is low, and hence the charge pump turns on right away. However, the charge pump will not turn off until IVCC develops, because IntEn- will be low until IVCC develops. By the time the pump turns off, VBB could become too low, for example, about −3V or −4V. Such low VBB values could increase the current leakage across pn-junctions in the wells or substrate biased by VBB. The memory cells could get discharged, losing information.

Therefore, there is a need for an improved generator of bias voltages and other signals that are generated from signals which take time to develop on power-up.

SUMMARY OF THE INVENTION

The present invention provides in some embodiments circuits and methods for generating signals from other signals that take time to develop on power-up. In some embodiments, a signal generator generates a signal (e.g. VBB) from a first signal (e.g., EVCC) during power-up, and from a second signal (e.g. IVCC) after the second signal has developed.

In some embodiments which generate a bias voltage VBB from an external supply voltage EVCC during powerup and from IVCC after IVCC has developed, IVCC has the same value for different EVCC values. When IVCC has developed, IVCC will keep VBB at a target level (for example, −1.5V) independent of the EVCC level. During power-up, VBB is generated from EVCC, and the VBB level depends on the EVCC level. However, this VBB level does not exceed the target level in magnitude. In some embodiments, the target level is −1.5V, and the VBB level during power-up is −0.5V for EVCC=3.3V and −1V for EVCC=5V. The VBB level of −0.5V or −1V reduces the likelihood of a latch-up during power-up. At the same time, VBB does not reach negative values that could cause significant current leakage.

Other features and advantages of the invention are described below. The invention is defined by the appended claims.

DESCRIPTION OF PREFERRED EMBODIMENTS

FIGS. 3–6 illustrate a VBB generator which generates acceptable VBB values during power-up and beyond. Circuit 310 of FIG. 3 generates an enable signal ExtEn referenced to EVCC. Signal ExtEn controls the VBB charge pump (shown in FIG. 6) during power-up before IVCC has developed. See the timing diagram of FIG. 7. In FIG. 7, the power is turned on at a time t0, and the external voltage EVCC reaches its final value of 3.3V of 5.0V shortly thereafter. The enable signal ExtEn reaches the EVCC level at about the same time, starting the charge pump. However, ExtEn allows the charge pump to pump the bias voltage VBB only to about −0.5V if EVCC=3.3V, or to −1.0V if EVCC=5.0V. The enable signal ExtEn will not allow the bias voltage VBB to reach its target value of −1.5V.

Figure 4:
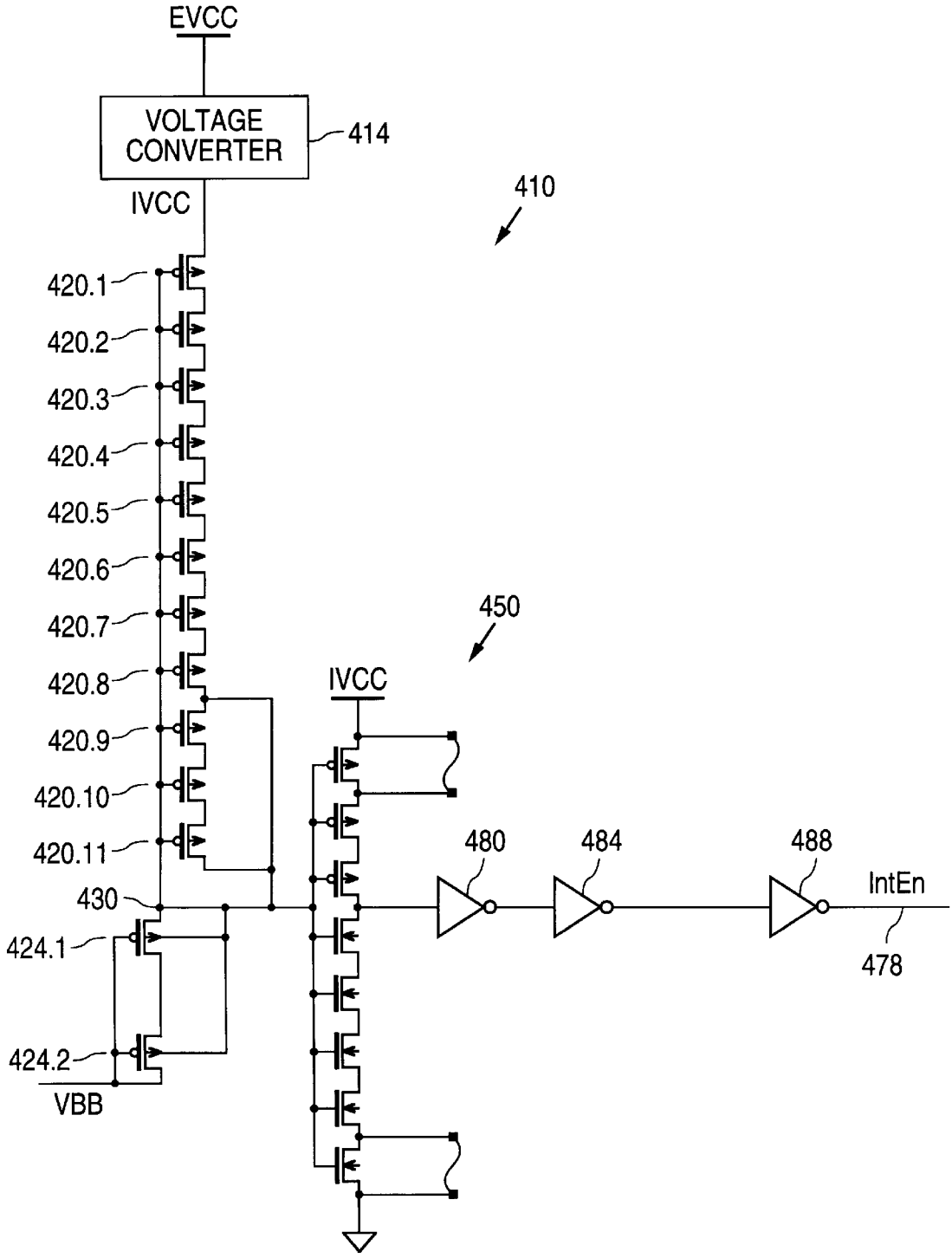

The circuit of FIG. 4 generates the enable signal IntEn referenced to IVCC. At a time t1 (FIG. 7), IVCC becomes sufficiently positive to take over the charge pump control. Then the circuit of FIG. 5 couples IntEn to the charge pump. IntEn will cause the charge pump to drive the bias voltage VBB to its target value of −1.5V. This low VBB value will keep the enable signal ExtEn low, preventing the value of the external supply voltage EVCC from affecting VBB.

Figure 1:
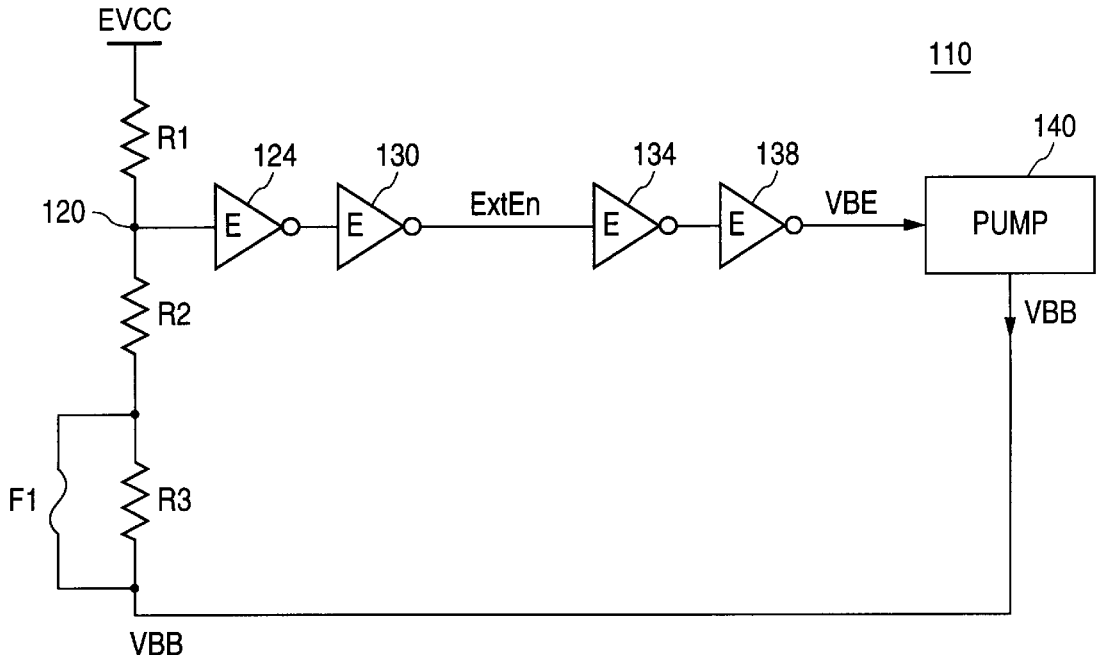
FIG. 1 (PRIOR ART)
FIGS. 1 and 2 are circuit diagrams of prior art bias voltage generators.
Figure 2:
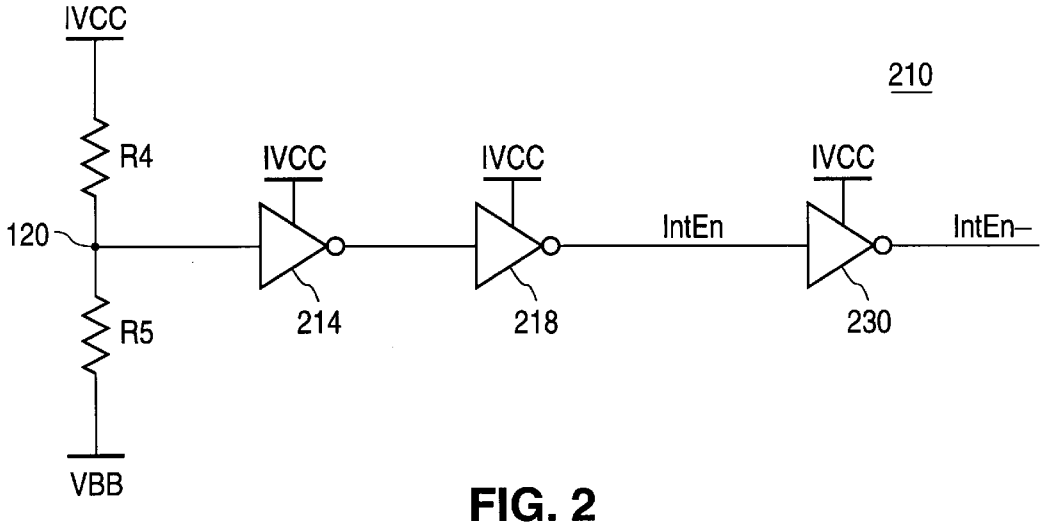
FIG. 2 (PRIOR ART)
Figure 3:
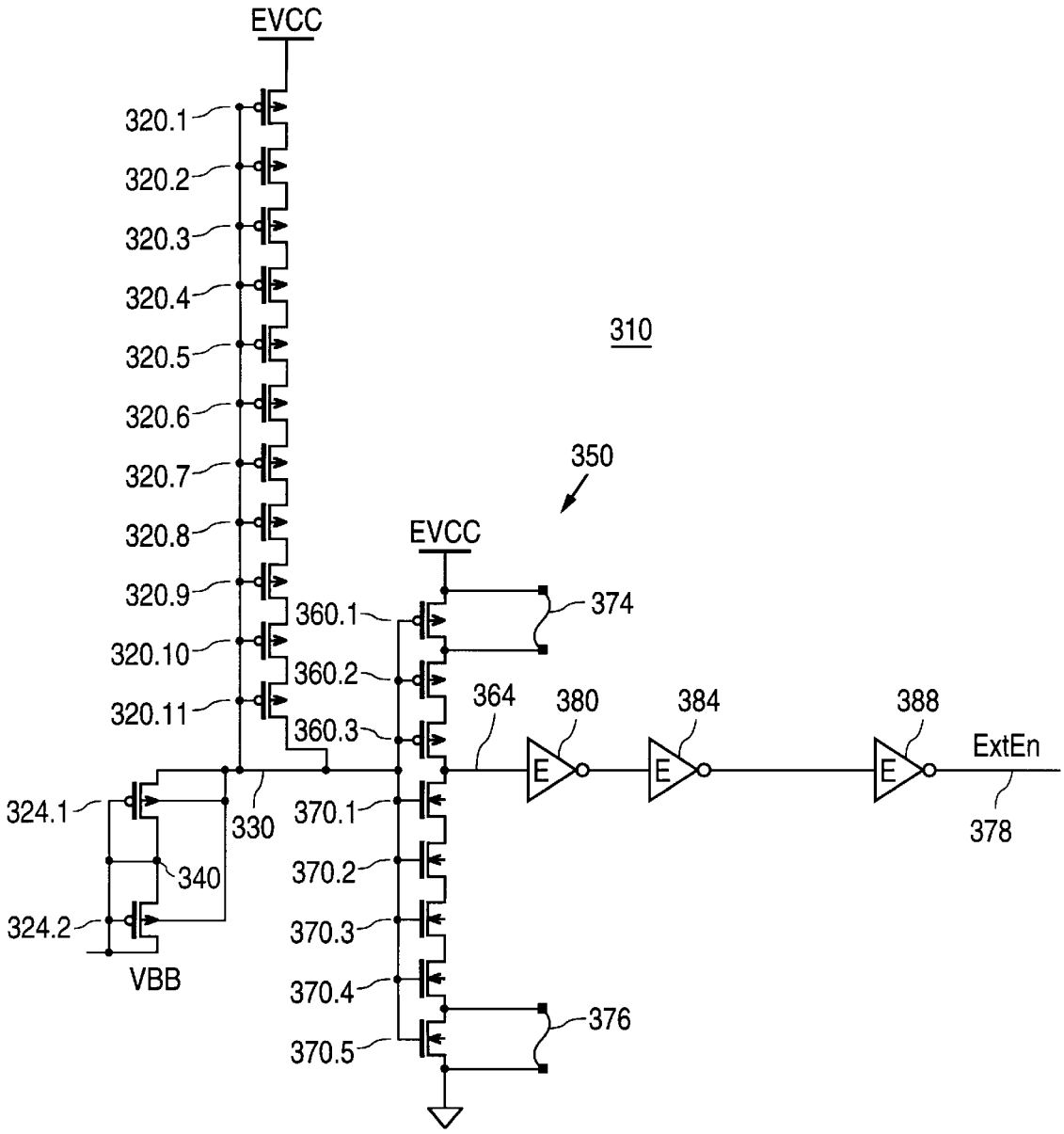
FIGS. 3–6 are a circuit diagram of a bias voltage generator according to the present invention.

Turning to FIG. 3, PMOS transistors 320 (i.e. transistors 320.1–320.11) and PMOS transistors 324 are connected between the external power supply voltage EVCC and the bias voltage VBB to form a voltage divider. Transistors 320 are connected in series between the external supply voltage EVCC and output node 330 of the voltage divider. The gates of transistors 320 are connected to node 330. All of transistors 320 are made in an N-well connected to EVCC. Transistors 324.1, 324.2 are connected in series between node 330 and the bias voltage VBB. The gates of transistors 324 are connected to the bias voltage VBB. Transistors 324.1, 324.2 are made in an N-well connected to node 330. The node between transistors 324.1 and 324.2, i.e. at the drain of transistor 324.1 and the source of transistor 324.2, is shown at 340. A metal mask option allows shorting the node 340 to the bias voltage VBB, thus shunting transistor 324.2.

Node 330 is connected to the input of inverter 350 powered by EVCC. (In the embodiment being described with respect to FIGS. 3–6, all inverters and logic gate are CMOS circuits. Non-CMOS circuits are used in other embodiments.) The trip point of inverter 350 is one-half of EVCC. Transistors 320 and 324 are chosen so that when EVCC=5V, node 330 is at one-half of EVCC when VBB=−1V, and when EVCC=3.3V, node 330 is at one-half of EVCC when VBB is −0.5V. The combined gate length of transistors 320 and 324 is chosen large to keep the current through the voltage divider small (1 to 10 $\mu$A in some embodiments). The channel width/length transistor dimensions for one embodiment are given in the appendix below.

Inverter 350 is also made with a large combined gate length to reduce the current through the inverter when both the PMOS transistors 360 of the inverter and the NMOS transistors 370 are on, since node 330 can be near the inverter trip voltage for a significant period of time during power-up. PMOS transistors 360.1, 360.2, 360.3 are connected in series between the power supply voltage EVCC and the inverter output 364. NMOS transistors 370.1 through 370.5 are connected in series between node 364 and ground. The gates of transistors 360, 370 are connected to node 330. Fuses 374, 376 can be used to optionally shunt respective transistors 360.1, 370.5.

The output 364 of inverter 350 is connected to the output 378 of circuit 310 through three serially connected inverters 380, 384, 388. The three inverters are powered by EVCC. Output 378 is the output of inverter 388. Output 378 provides the signal ExtEn.

Circuit 410 of FIG. 4 is powered by the internal supply voltage IVCC, but in other respects is similar to circuit 310. IVCC is generated from EVCC by a conventional voltage converter 414. In circuit 410, PMOS transistors 420.1 through 420.11 are connected in series between the internal supply voltage IVCC and a node 430. The gates of transistors 420 are connected to node 430. Transistors 420 are formed in an N-well connected to the internal supply voltage IVCC. A metal mask option allows optionally shorting the drain of transistor 420.8 to node 430. PMOS transistors 424.1, 424.2 are connected in series between node 430 and the bias voltage VBB. The gates of transistors 424 are connected to the bias voltage. Transistors 424 are formed in an N-well connected to node 430. The dimensions of transistors 420, 424 are selected so that the node 430 is at one-half of IVCC (1.5V) when IVCC is 3.0V and the bias voltage VBB=−1.5V. One-half of IVCC is the trip point of inverter 450. Thus, when VBB is above −1.5V, the output signal IntEn is high. When VBB is below −1.5V, IntEn is low.

Inverters 450, 480, 484, 488 are connected in series, in that order, between node 430 and the circuit output 478 providing the enable signal IntEn. Inverters 450, 480, 484, 488 are identical to inverters 350, 380, 384, 388 respectively, except that the inverters 450, 480, 484, 488 are powered by the internal supply voltage IVCC.

Figure 5:
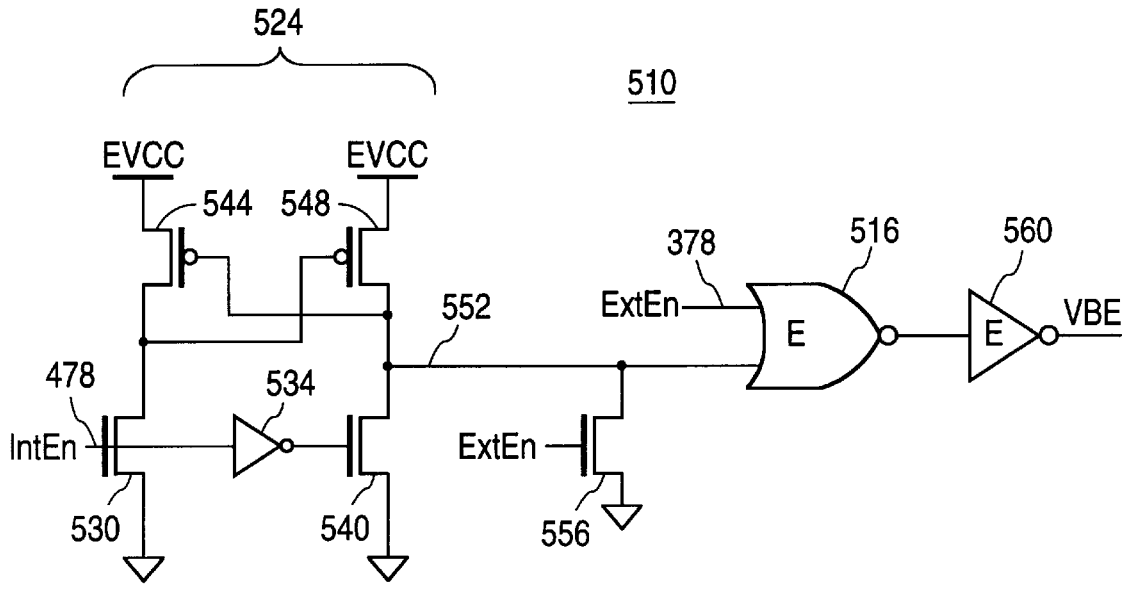

FIG. 5 shows a circuit 510 which receives the enable signals ExtEn and IntEn and generates the charge pump enable signal VBE. Output 378 of circuit 310 is connected to one input of a two-input NOR gate 516. NOR gate 516 is powered by the external supply EVCC. The other input of NOR gate 516 is coupled to output 478 of circuit 410 through level shifter 524. More particularly, output 478 is connected to the gate of NMOS transistor 530 and the input of CMOS inverter 534. Inverter 534 is powered by the internal supply IVCC. The output of inverter 534 is connected to the gate of NMOS transistor 540. The sources of transistors 530, 540 are connected to ground. The drain of transistor 530 is connected to the drain of PMOS transistor 544 and the gate of PMOS transistor 548. The drain of transistor 540 is connected to the drain of transistor 548 and the gate of transistor 544. The sources of PMOS transistors 544, 548 are connected to the external supply voltage EVCC. Node 552 at the drains of transistors 540, 548 is connected to an input of NOR gate 516. When IntEn changes between ground and IVCC, node 552 changes between ground and EVCC respectively.

Node 552 is connected to the drain of NMOS transistor 556 whose source is connected to ground. The gate of transistor 556 is connected to output 378, thus receiving the signal ExtEn.

The output of NOR gate 516 is connected to the input of CMOS inverter 560 powered by the external supply EVCC. The output of inverter 516 provides the pump enable signal VBE. The pump is on when VBE is high (at EVCC).

Circuits 310, 410, 510 operate as follows. When the power is turned on, the external voltage EVCC quickly reaches its full value of 5.0V or 3.3V. The bias voltage VBB is 0V (unless a residual charge is left on the VBB terminal from a previous period of operation). If VBB=0V, node 330 (FIG. 3) will be above the trip voltage of inverter 350. Hence, ExtEn will be high. NOR gate 516 and inverter 560 will drive VBE high, turning on the charge pump.

The high signal ExtEn turns on transistor 556. Transistor 556 is larger than transistor 548. Hence, transistor 556 pulls the node 552 to ground. Therefore, transistor 544 is on. IntEn is low, keeping transistor 530 off.

When VBE reaches its low value of −1.0V (for EVCC=5V) or −0.5V (for EVCC=3.3V), signal ExtEn becomes low, turning off the charge pump. When VBE rises above the respective value of −1.0V or −0.5V, ExtEn becomes high, turning on the charge pump. Node 552 remains low until the signal IntEn becomes sufficiently high to turn on transistor 530.

The enable signal ExtEn keeps VBB above the −1.5V switch point of circuit 410 (FIG. 4). Therefore, the signal IntEn will eventually rise, turning on transistor 530. Transistor 530 is larger than transistors 544, and hence transistor 530 will pull the gate of transistor 548 down and will keep it there as long as IntEn is high, i.e. as long as VBB is above −1.5V. Transistor 548 will therefore be on. If signal ExtEn is not low at the time transistor 530 turns on, the signal ExtEn will become low later (when VBB reaches −1V or −0.5V, depending on the EVCC level). At that time, transistor 556 will turn off, and node 552 will be pulled up. Hence, the charge pump will be on. Consequently, VBB will fall below the ExtEn switch point of −1.0V or −0.5V, and therefore the signal ExtEn will remain low allowing the node 552 (and hence the signal IntEn) to control the charge pump. IntEn will cause VBB to fall to about −1.5V and to stay there during the rest of the memory operation.

Figure 6:
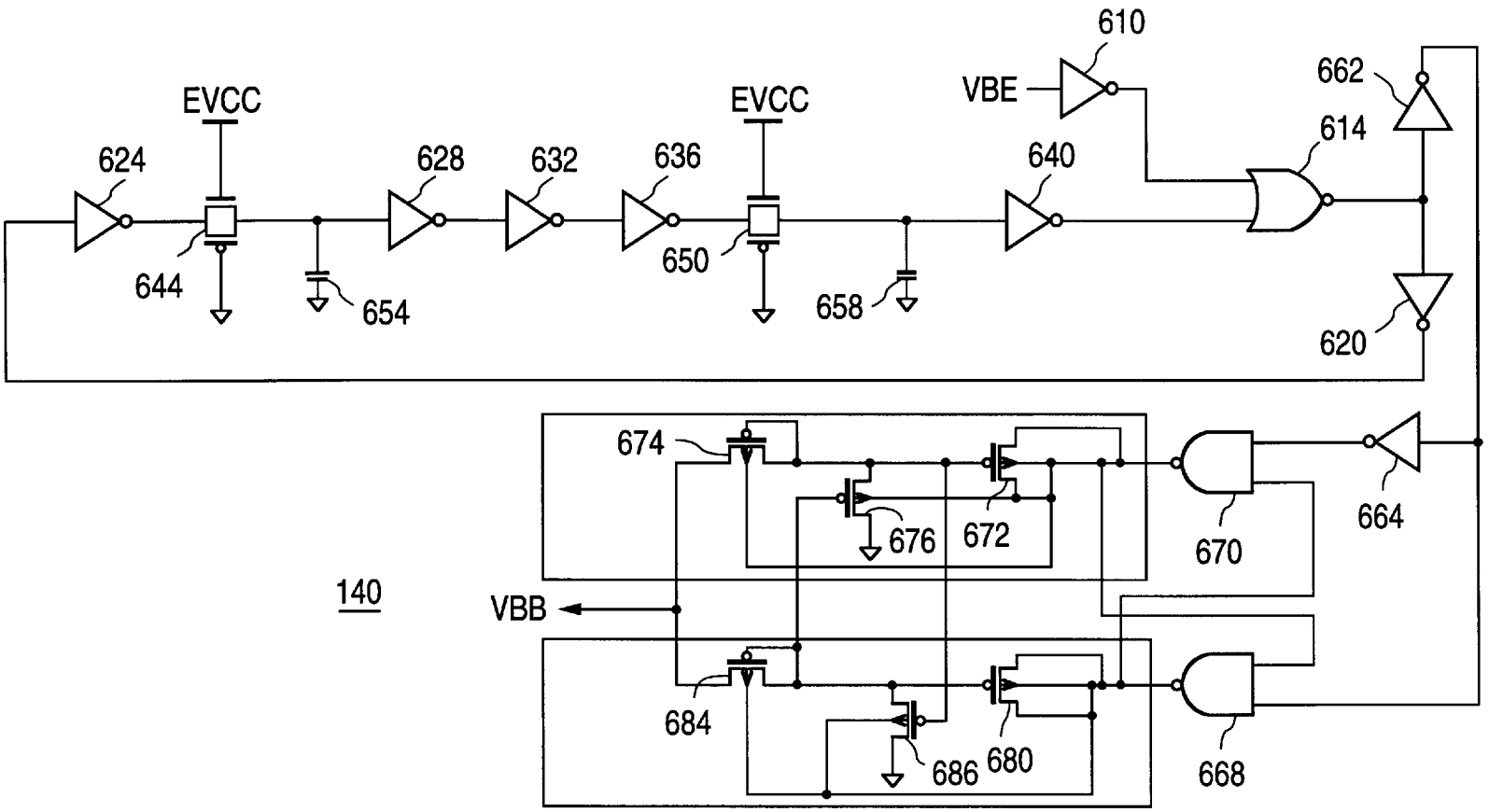
FIG. 6 (PRIOR ART)
Figure 7:
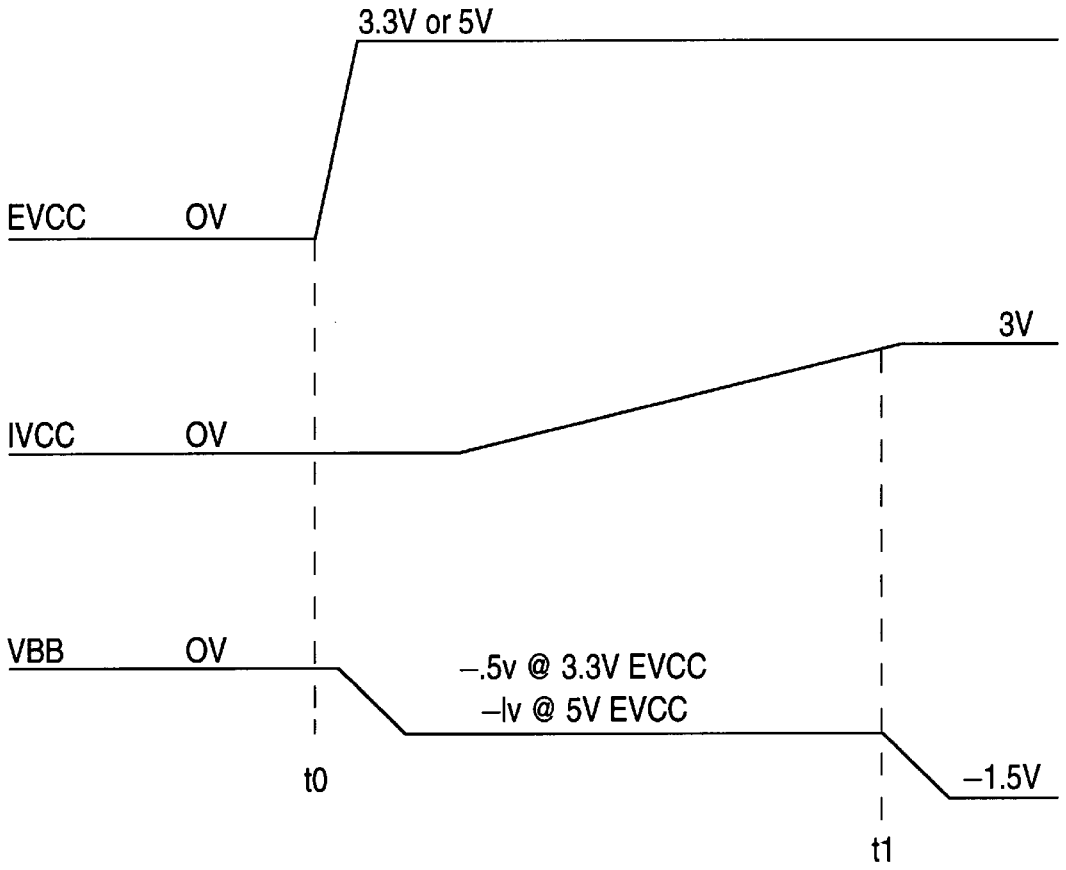
FIG. 7 is a timing diagram for the generator of FIGS. 3–6.

FIG. 6 illustrates one embodiment of charge pump 140. All the logic gates and inverters in FIG. 6 are powered by the external supply voltage EVCC. The pump enable signal VBE is provided to the input of inverter 610 whose output is connected to an input of a two-input NOR gate 614. The output of gate 614 is connected to the other input of the same gate through serially connected inverters 620, 624, 628, 632, 636 and 640. Transmission gate 644 is connected between the output of inverter 624 and the input of inverter 628. Transmission gate 650 is connected between the output of inverter 636 and the input of inverter 640. The NMOS gates of transmission gates 644, 650 are connected to external voltage EVCC, and the PMOS gates are grounded. Capacitor 654 is connected between the input of inverter 628 and ground. Capacitor 658 is connected between the input of inverter 640 and ground. The serially connected inverters, the transmission gates, the capacitors and NOR gate 614 form an oscillator enabled by VBE.

The output of NOR gate 614 is connected to the input of inverter 662. The output of inverter 662 is connected to the input of inverter 664 and to one input of two-input NAND gate 668. The other input of the NAND gate is connected to the output of two-input NAND gate 670. One input of NAND gate 670 is connected to the output of inverter 664 and the other input is connected to the output of gate 668.

The output of gate 670 is connected to the source, drain and body regions of PMOS transistor 672 which acts as a capacitor. The gate of transistor 672 is connected to the drain and the gate of PMOS transistor 674 which acts as a diode. The source of transistor 674 is connected to the bias voltage terminal VBB. PMOS transistor 676 is connected between the gate of transistor 672 and ground. Transistors 672, 674, 676 are formed in an N well connected to the output of gate 670.

The output of gate 668 is connected to the source, drain and body regions of PMOS transistor 680 which acts as a capacitor. The gate of transistor 680 is connected to the drain and the gate of PMOS transistor 684 which acts as a diode. The source of transistor 684 is connected to the bias voltage terminal VBB. PMOS transistor 686 is connected between the gate of transistor 680 and ground. Transistors 680, 684, 686 are formed in an N well connected to the output of gate 668 and spaced from the N well in which the transistor 672, 674, 676 are formed. The gate of transistor 676 is connected to the gate of transistor 680. The gate of transistor 686 is connected to the gate of transistor 672.

Figure 8:
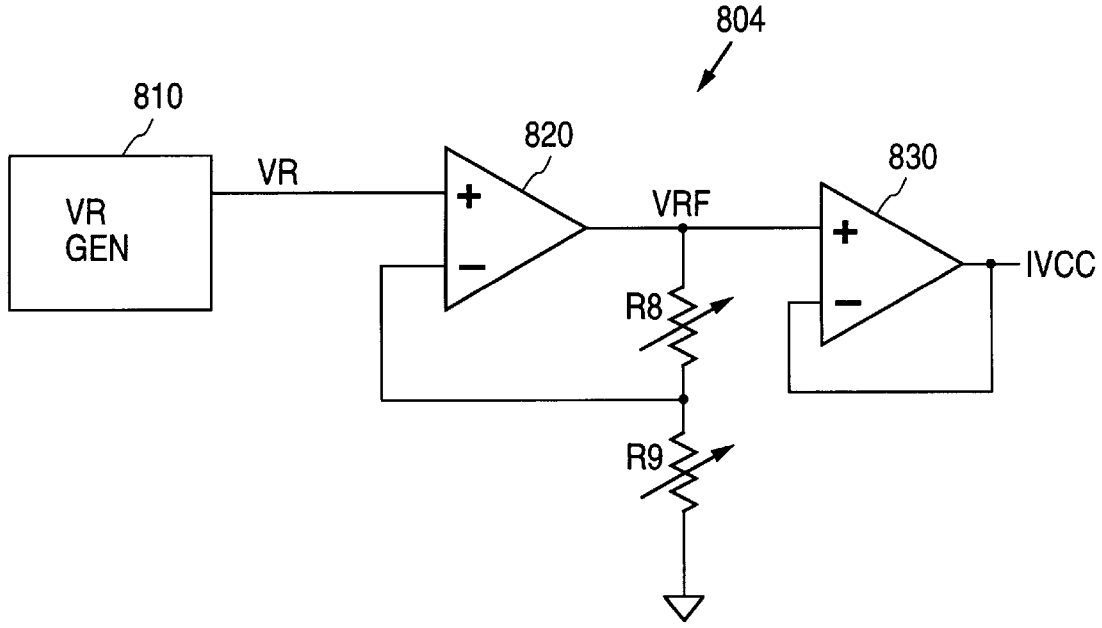
FIG. 8 (PRIOR ART)
FIG. 8 is a block diagram of a prior art IVCC generator suitable for use with the bias voltage generator of FIGS. 3–6.

FIG. 8 shows a prior art IVCC generator 804 suitable for use with the circuits of FIGS. 3–6. In FIG. 8, reference voltage generator 810 and operational amplifiers 820 and 830 are CMOS circuits powered by EVCC. The resistances of resistors R8, R9 can be adjusted with fuses. Voltage generator 810 and sense amplifiers 820, 830 are made slow to reduce their DC power consumption. In some embodiments, the DC current through the IVCC generator 804 is a few tenths of a microampere. Consequently, and because of a high capacitance of the IVCC terminal (the output of amplifier 830), IVCC takes a few milliseconds to develop on power-up in some embodiments.

In some embodiments, VBB is a positive voltage that biases an N well or an N substrate. The integrated circuit is a DRAM or another kind of memory, or a non-memory circuit. The integrated circuit, or at least portions of the circuit, are designed to operate properly at different EVCC values, e.g. at 3.3V and 5.0V. The circuit includes a voltage converter to generate an internal power supply voltage IVCC lower in magnitude than EVCC. The bias voltage VBB is generated by a charge pump which, if left on sufficiently long, can pump VBB to a desired high value VBB1. When the power is first turned on, circuit 510 couples the output ExtEn of circuit 310 to the charge pump control input VBE. The circuit 310 transistors are chosen so that the signal ExtEn causes the bias voltage VBB to rise to a level VBB2. Level VBB2 depends on the external voltage EVCC. However, for any EVCC value, the level VBB2 is lower in magnitude than the target level VBB1.

When IVCC has become sufficiently high, circuit 510 couples the output IntEn of circuit 410 to the signal VBE, and decouples ExtEn. The transistor dimensions of circuit 410 are chosen to keep bias voltage VBB at the target value VBB1.

The above embodiments illustrate but do not limit the invention. In particular, the invention is not limited by any particular circuitry, by transistor or capacitor sizes, or by voltage levels. Negative values of EVCC or IVCC, or non-ground reference voltages, are used in some embodiments. The invention is not limited to CMOS technology or to memories. Other embodiments and variations are within the scope of the invention, as defined by the appended claims.

APPENDIX

All the dimensions are in micrometers.

| Transistors and capacitors | Dimensions |
|---|---|
| Transistor 320.1 | 4/8.6 |
| Each of transistors 320.2–320.11 | 4/20 |
| Transistor 324.1 | 4/400 |
| Transistor 324.2 | 4/515 |
| Transistor 360.1 | 4/4 |
| Transistor 360.2 | 4/12 |
| Each of transistors 360.3 and 370.1 through 370.4 | 4/20 |
| Transistor 370.5 | 4/8 |
| Each of inverters 380, 384 | P = 4/4 (P-channel dimensions), N = 4/10 (N-channel dimensions) |
| Inverter 388 | P = 8/1, N = 4/1. |
| Transistors 420.1–420.11 | Same as transistors 320.1–320.11 respectively |
| Transistor 424.1 | 4/646 |
| Transistor 424.2 | 4/716 |
| Inverters 450, 480, 484, 488 | Same as inverters 350, 380, 384, 388 respectively. |
| Each of transistors 544, 548 | 4/8 |
| Each of transistors 530, 540, 556 | 4/4 |
| Each of inverters 534, 560 | P = 8 (that is, 8/1), N = 4 |
| NOR gate 516 | P = 16, N = 4 |
| Each of inverters 610, 620, 662, 664 | P = 8, N = 4 |
| Each of inverters 624, 628, 632, 636 | P = 4/8, N = 6/1.5 |
| Each of transmission gates 644, 650 | P = 4/4, N = 4/8 |
| Each of capacitors 654, 658 | 25/30 |
| Inverter 640 | P = 4/2.4, N = 6/1.5 |
| NOR gate 614 | P = 16, N = 4 |
| Each of NAND gates 670, 668 | P = 60, N = 60 |
| Each of transistors 672, 680 | 150/82 |
| Each of transistors 676, 686 | 160/1 |
| Each of transistors 674, 684 | 600/1 |

We claim:

1. A circuit for generating a signal S0, the circuit comprising:

a circuit C1 having a control input, for generating the signal S0;

a first control circuit for receiving a first power supply signal and generating a first control signal to control the circuit C1;

a second control circuit for receiving a second signal having a characteristic substantially independent of the first power supply signal, and for generating a second control signal for controlling the circuit C1; and a coupling circuit for receiving the first and second control signals and for coupling the first control signal to the control input of the circuit C1 during power-up while the second signal is developing, and for coupling the second control signal to the control input when the second signal has developed.

2. The circuit of claim 1 wherein the characteristic independent of the first power supply signal is a voltage level of the second signal.

3. The circuit of claim 1 wherein when the first control signal is coupled to the control input, the first control signal drives the signal S0 to a first voltage level dependent on the first power supply signal, and when the second control signal is coupled to the control input, the second control signal drives the signal S0 to a second voltage level independent of the first power supply signal.

4. The circuit of claim 3 wherein when the first control signal is coupled to the control input, the signal S0 becomes closer in voltage to the second level but does not reach the second level.

5. The circuit of claim 1 further comprising a circuit for generating the second signal from the first power supply signal.

6. The circuit of claim 1 further comprising one or more transistors whose body regions are biased by the signal S0.

7. The circuit of claim 6 wherein the body regions have the P conductivity type and the signal S0 is to bias the body regions to a negative voltage.

8. The circuit of claim 6 wherein the one or more transistors are transistors of memory cells.

9. The circuit of claim 8 wherein the memory cells are dynamic random access memory cells.

10. The circuit of claim 1 wherein the coupling circuit is to couple the second control signal to the control input when the second signal has developed sufficiently for the second control signal to cause the signal S0 to be at a predetermined level.

11. A method for generating a signal S0, the method comprising:

receiving a first signal and generating a second signal from the first signal;

during power-up while the second signal is being developed, generating the signal S0 from the first signal; and after the second signal has developed, generating the signal S0 from the second signal, wherein when the signal S0 is being generated from the first signal, the signal S0 reaches a first voltage level dependent on the voltage level of the first signal, and when the signal S0 is being generated from the second signal, the signal S0 is kept at about a second voltage level independent of the voltage level of the first signal.

12. A method for generating a signal S0, the method comprising:

receiving a first signal, and generating a second signal from the first signal;

during power-up while the second signal is being developed, generating the signal S0 from the first signal; and after the second signal has developed, generating the signal S0 from the second signal wherein the signal S0 biases body regions of one or more transistors.

13. The method of claim 12 wherein the signal S0 is a negative voltage biasing P conductivity type body regions of one or more transistors.

14. The method of claim 11 wherein the first signal is a power supply signal, and the second signal has the same level at different levels of the power supply signal.

* * * * *